US010473337B2

(12) United States Patent
Amiri

(10) Patent No.: US 10,473,337 B2
(45) Date of Patent: Nov. 12, 2019

(54) VENTILLATION ENCLOSURE ASSEMBLY

(71) Applicant: Toomaj Amiri, Tehran (IR)

(72) Inventor: Toomaj Amiri, Tehran (IR)

( * ) Notice: Subject to any disclaimer, the term of this patent is extended or adjusted under 35 U.S.C. 154(b) by 308 days.

(21) Appl. No.: 15/369,845

(22) Filed: Dec. 5, 2016

(65) Prior Publication Data

US 2018/0038600 A1 Feb. 8, 2018

Related U.S. Application Data

(63) Continuation of application No. PCT/IB2016/052009, filed on Apr. 8, 2016.

(60) Provisional application No. 62/308,896, filed on Mar. 16, 2016.

(51) Int. Cl.
*F24C 15/20* (2006.01)

(52) U.S. Cl.
CPC ..... *F24C 15/2092* (2013.01)

(58) Field of Classification Search
CPC ..... F24C 15/2092; F24C 15/20; F24F 7/00
USPC ..... 454/65; 126/299 R
See application file for complete search history.

(56) References Cited

U.S. PATENT DOCUMENTS 424,628 A * 4/1890 Taylor ..... F24C 15/2092 126/301
913,465 A * 2/1909 Brouillet ..... F24C 15/2092 126/39 C
931,312 A * 8/1909 Kahn ..... F24C 3/027 126/299 R
1,954,257 A 4/1934 Nessel
4,788,964 A * 12/1988 Dorsey ..... F24C 15/20 126/299 D
5,967,136 A * 10/1999 Gray ..... F24C 15/2042 126/299 C
7,034,269 B2 * 4/2006 Jeong ..... F24C 15/2092 126/299 D

FOREIGN PATENT DOCUMENTS

CN 101858612 A * 10/2010 ..... F24C 15/20

OTHER PUBLICATIONS

Engineered Kitchen Ventilation Systems. Hoods, Fire Systems, Pollution Control, Controls, Accessories, http://www.accurex.com/Products.aspx?m=c&c=7.

* cited by examiner

*Primary Examiner* — Gregory L Huson
*Assistant Examiner* — Dana K Tighe
(74) *Attorney, Agent, or Firm* — NovoTechIP International PLLC

(57) ABSTRACT

Disclosed herein is an enclosure for a hood assembly that can include four vertically extending wall assemblies that form four sides of the enclosure. The wall assemblies are configured to be placed under the hood assembly and they can be vertically extended from under the hood over a fume-producing kitchen device to provide an extended channel for guiding the fumes towards the exhaustion opening of the hood assembly.

10 Claims, 17 Drawing Sheets

VENTILLATION ENCLOSURE ASSEMBLY

CROSS REFERENCE TO RELATED APPLICATION

This application claims the benefit of priority from U.S. Provisional Patent Application Ser. No. 62/308,896, filed on Mar. 16, 2016, and entitled "Hood Cover Assembly," and PCT Application Serial No. PCT/IB2016/052009, filed on Apr. 8, 2016, and entitled "Hood Cover Assembly," both of which are incorporated by reference herein in its entirety.

TECHNICAL FIELD

This application generally relates to ventilation enclosures, and particularly to methods and devices directed to improve air flow into a fume enclosure and its assembly.

BACKGROUND

Cooking hoods are designed to extract fumes and in some implementations they are mounted on a surface near a fume-producing device. Examples of fume-producing devices may include, but are not limited to, stoves or grills. The cooking hood extracts the fumes emanating from the surface of the fume-producing device.

SUMMARY

The following brief summary is not intended to include all features and aspects of the present application, nor does it imply that the application must include all features and aspects discussed in this summary.

In one general aspect, the present disclosure describes an enclosure for a hood assembly that can include four vertically extending wall assemblies that form four sides of the enclosure and the wall assemblies are configured to be attached under the hood assembly.

In another general aspect, the present disclosure describes an enclosure for a hood assembly that can include: a top support assembly configured to be attached under the hood assembly; and four vertically extending wall assemblies that form four sides of the enclosure. The wall assemblies are configured to be coupled with the top support assembly.

According to another general aspect, the present disclosure describes a method for improving fume capture efficiency of a hood assembly placed over a fume-producing device, comprising steps of: providing four vertically extending wall assemblies configured to form four sides of an enclosure; and placing the enclosure under the hood assembly wherein the enclosure is configured to enclose the area under the hood assembly over the fume-producing kitchen device.

The above-mentioned general aspects may include one or more of the following features. The four wall assemblies can be pivotally attached to the hood assembly. Each wall assembly can include a plurality of sub-panel assemblies, wherein the sub-panel assemblies are interconnected to form the wall assembly.

According to one implementation, the sub-panel assemblies can be slidably interconnected to form the wall assembly. Each sub-panel assembly can include: a panel; and two sliding track. The two sliding track mechanisms can be mounted on transverse sides of the panel. The sliding track mechanism of the sub-panel assemblies can be slidably interconnected with one another to form the wall assemblies. The panel can be a planar elongated rectangular panel and it can be made of materials such as transparent glass, translucent glass, semi-opaque glass, opaque glass, reinforced glass, or polymers.

According to one implementation, each wall assembly can be configured to be vertically slidably adjustable between a fully retracted position to a fully vertically extended position independent form other wall assemblies.

According to some implementations, the top support structure can be mounted under the hood assembly. Alternatively, the top support structure is mounted on a surface near the hood assembly, such that the top support structure is placed under the hood assembly.

According to other implementations, the sub-panel assemblies can be pivotally interconnected to form a wall assembly. The sub-panel assemblies can be folded one by one to retract the wall assembly or they can be unfolded one by one to extend the wall assembly.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE DRAWINGS

Figure 1A:
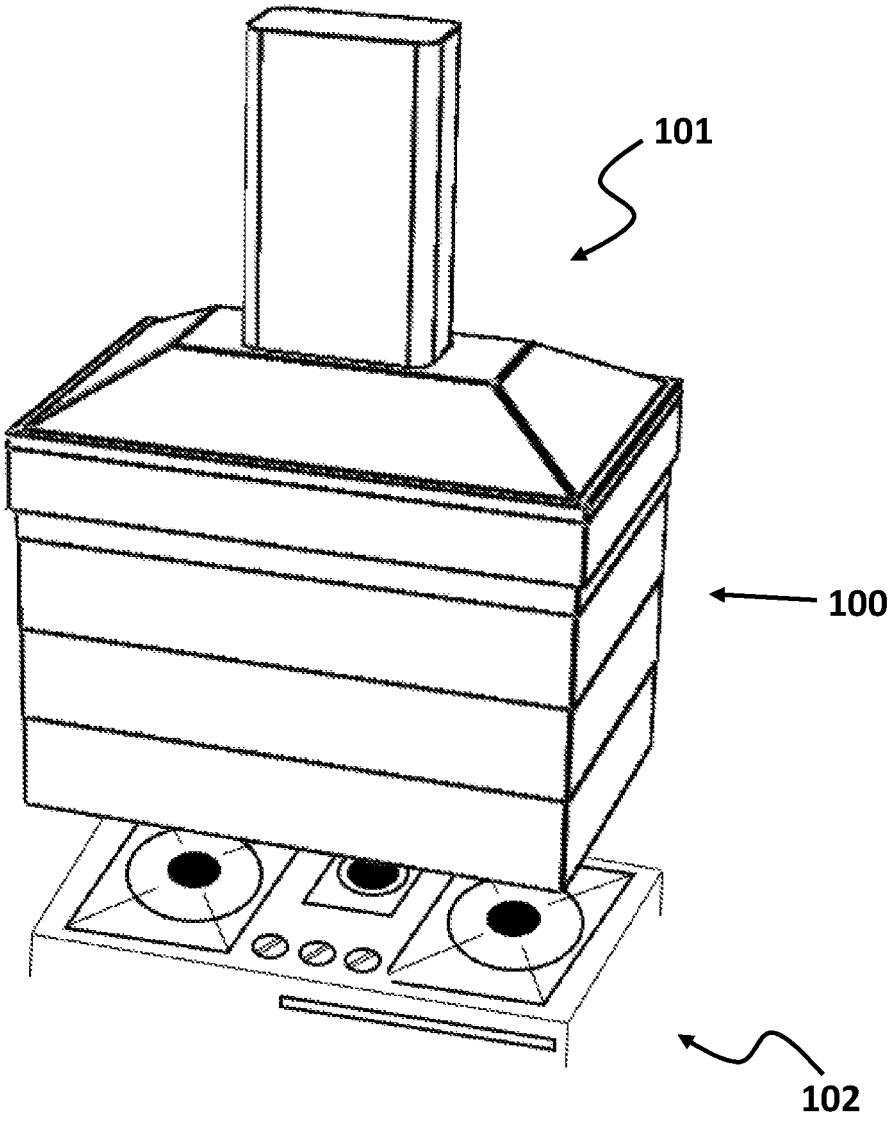
FIGS. 1A-1B illustrate an example kitchen hood assembly, according to one or more aspects of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

As used herein, the term "kitchen hood assembly" may refer to any mechanism to generate a forced ventilation channel for effluent plume adjacent to a heated, or fume-producing devices. The term "kitchen hood assembly" may also include, but is not limited to one or more grease filters, fans or tangential blowers for generating a vacuum or forced ventilation. The kitchen hood assembly may include any application including ducted, or vented application or ductless or recirculation application. The kitchen hood assembly may also include other components such as built-in lighting, matching accessories, such as backsplash panels, pot racks, shelf units, or dish racks. The kitchen hood assemblies may also include electronic model or electro-mechanical models or pure mechanical models. The kitchen hood assembly may further include, but not limited to electronic controls such as offer remote control, motorized height adjustment, thermal sensor, overheat protection, boost mode, delayed shut-off, filter cleaning reminder, active noise cancellation, temperature display, user presets (memory), and so on.

The present disclosure describes a method and device for improving fume capture efficiency of a hood, which is placed above a fume-producing device. Some examples of cooking devices may include kitchen stoves or grills. In an aspect, the method for improving fume capture efficiency of a kitchen hood assembly includes steps of: providing four vertically extending wall assemblies configured to form four sides of an enclosure; and placing the enclosure under the kitchen hood assembly in order to enclose the area under the hood assembly, which is in turn placed over the fume-producing device.

In some implementations, the present disclosure describes a kitchen hood assembly mountable over a fume-producing device. The kitchen hood assembly may be used to draw fumes emanating from a surface of a fume-producing device into an opening located above the fume-producing device. In other words, the kitchen hood assembly may define an extended channel corresponding to the area emanating from the surface of a fume-producing device to direct the fumes into the opening of the hood assembly. In another implementation, the kitchen hood assembly may be placed under a fume-producing device. The kitchen hood assembly may be used to draw fumes emanating from a surface of a fume-producing device into an opening located along the surface of the fume-producing device. For example, the opening may be on the same surface as the fume-producing device. For another example, the opening may be on the surface slightly lower than the fume-producing device.

The kitchen hood assembly can be, for example an integral part of a hoof exterior, or it can be mounted under a hood exterior. Alternatively, the kitchen hood assembly can be mounted on a surface near the hood exterior, such that the enclosure is placed under the hood exterior to define an extended channel under the hood over the fume-producing device.

Figure 1B:
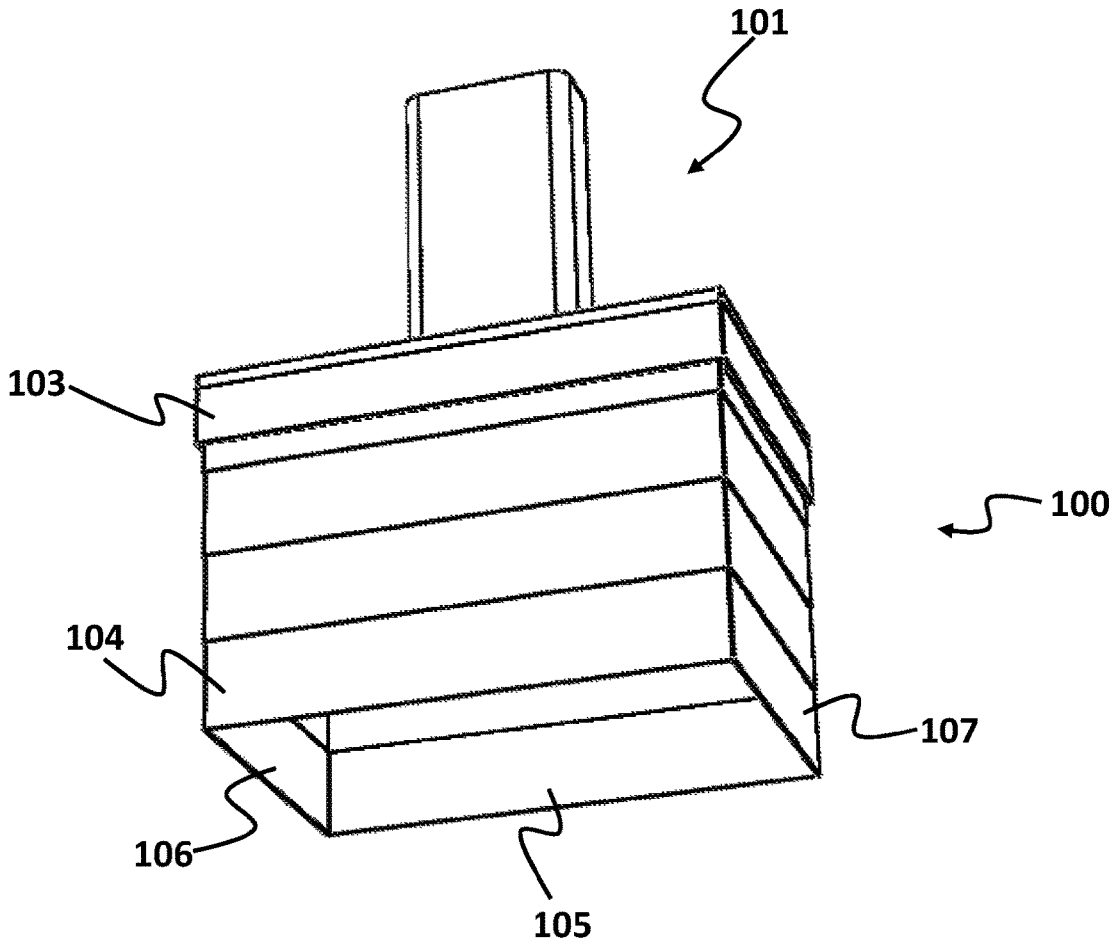

FIGS. 1A and 1B illustrate an implementation of a kitchen hood assembly 100 that can be mounted laterally on a hood exterior 101 above a cooking device 102. In one implementation, the kitchen hood assembly 100 defines a ventilation channel from the cooking device onto the hood assembly 100 to direct fumes toward the opening of the hood exterior 101. In another implementation, the kitchen hood assembly 100 can be mounted on a surface near the hood exterior 101, such that the enclosure 100 is placed under the hood exterior 101 and encloses the area under the hood exterior 101 above the fume-producing kitchen device 102 defining an extended channel under the hood exterior 101 that can direct the fumes upwardly toward the exhaustion opening of the hood exterior 101.

Referring to FIG. 1B, the kitchen hood assembly 100 may include a top support structure 103 movably attached to]four wall assemblies 104, 105, 106, and 107.

The four wall assemblies 104, 105, 106, and 107 may be planar surfaces mounted orthogonally to the top support structure 103, such that the four wall assemblies 104, 105, 106, and 107 define four sides of the enclosure for the kitchen hood assembly 100. The enclosure of the kitchen hood assembly 100 may be sized to fit the area over a cooking device 102. The top support structure 103 may be configured to function as an attachment interface that can be used to attach the kitchen hood assembly 100 under the hood exterior 101. Moreover, the top support structure 103 may be configured to provide an air-tight seal between the kitchen hood assembly 100 and the hood exterior 101. The wall assemblies 104, 105, 106, and 107 may be adapted and configured to substantially vertically extend downward from under the hood exterior 101 to various distances from the surface of the fume producing device 102. A user may select a distance be such that an air stream may be to be drawn into the enclosure 100 towards the exhaust opening of the hood exterior 101. Alternatively, the four wall assemblies 104, 105, 106, and 107 can be coupled to the hood exterior 101 directly without the top support structure 103.

Figure 2:
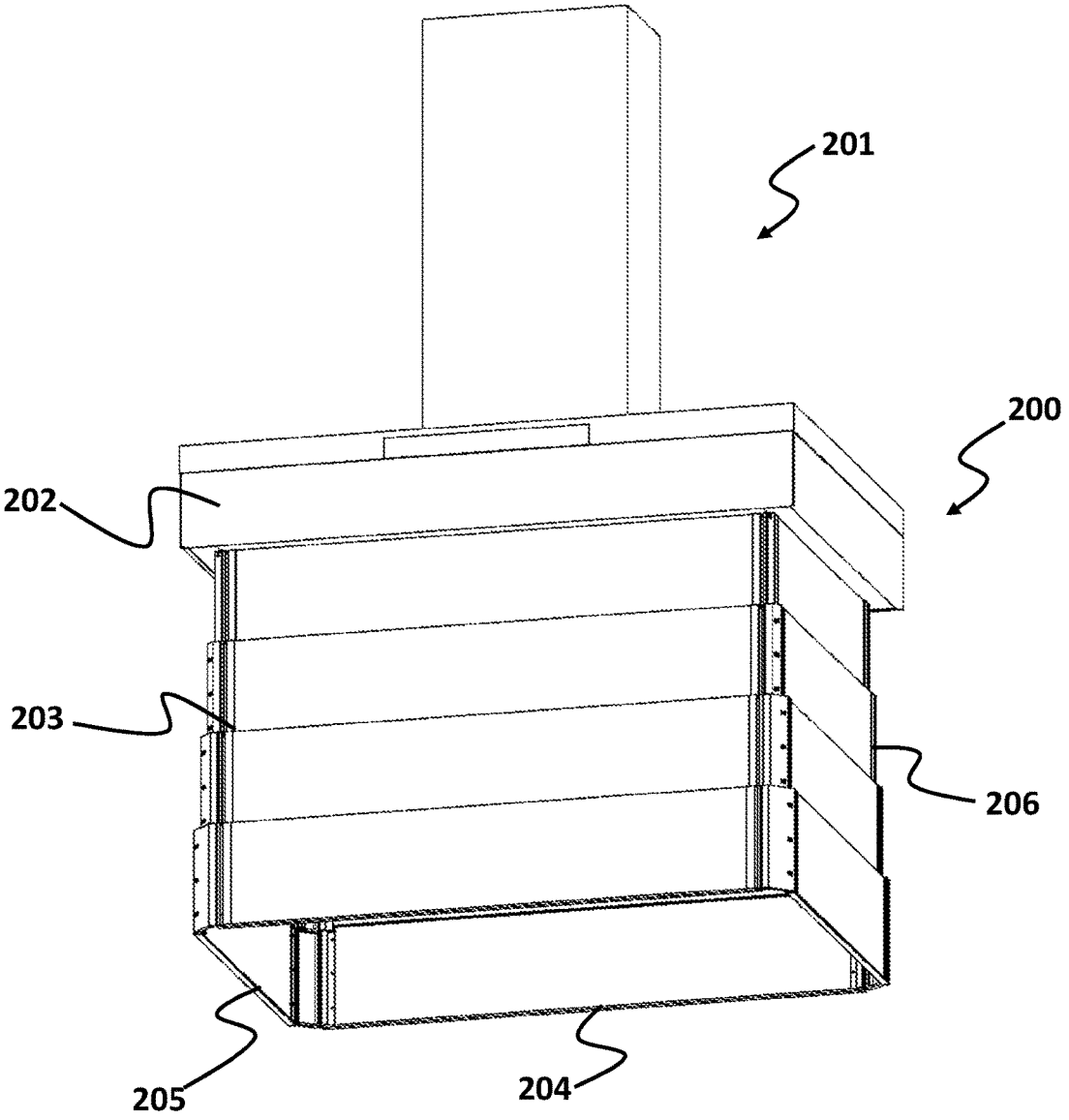
FIG. 2 illustrates an example vertically slidable kitchen hood assembly, according to one or more aspects of the present disclosure.

FIG. 2 depicts an example of a kitchen hood assembly 200 pursuant to one or more embodies of the present disclosure. Referring to FIG. 2 the kitchen hood assembly 200 may include a top support structure 202, and four vertically extendable wall assemblies 203, 204, 205, and 206. The top support structure 202 may be configured to be attached to the hood assembly 201. The four wall assemblies 203, 204, 205, and 206 can be coupled to the top support structure 202 in order to define four sides of the kitchen hood assembly 200.

Figure 3A:
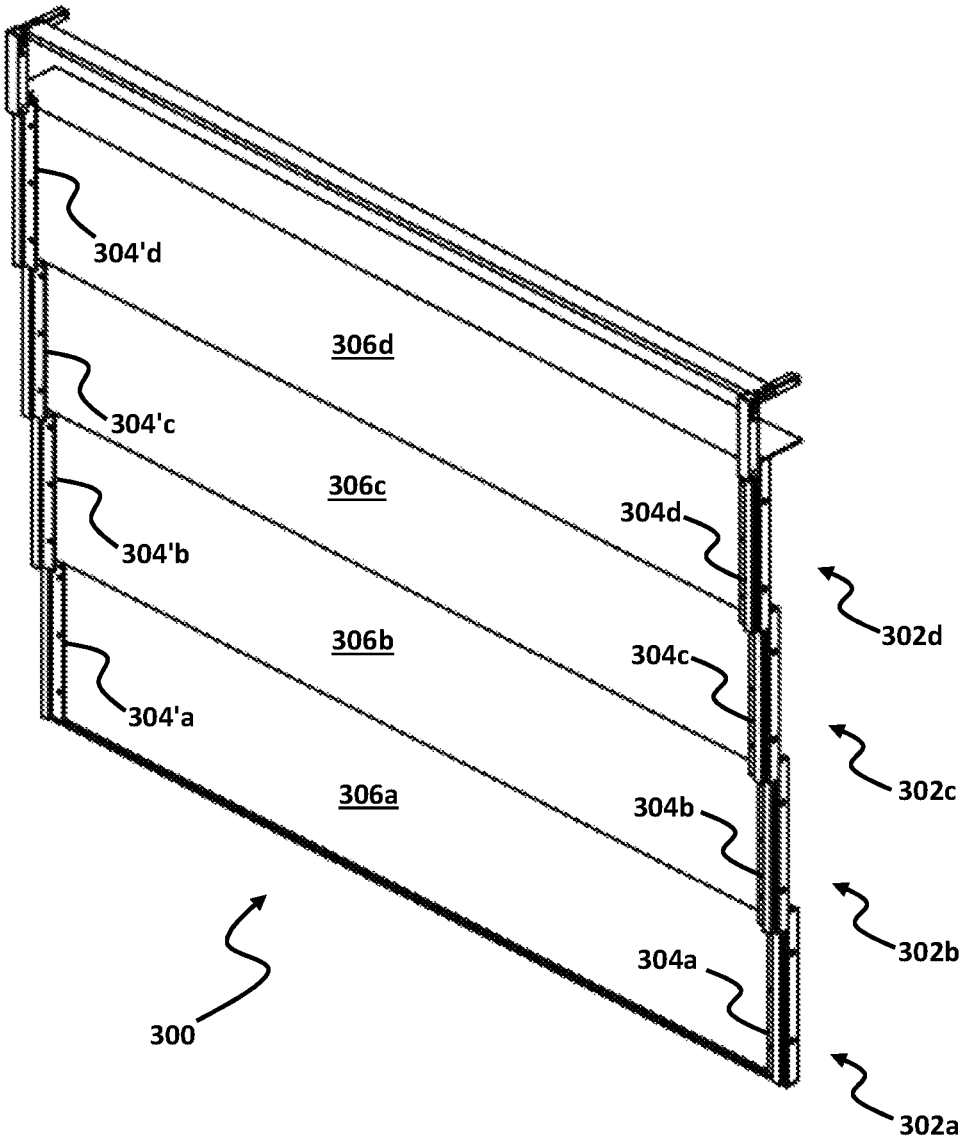
FIG. 3A illustrates a cross section of a wall assembly panel in accordance with at least one implementation of the present disclosure.
Figure 3B:
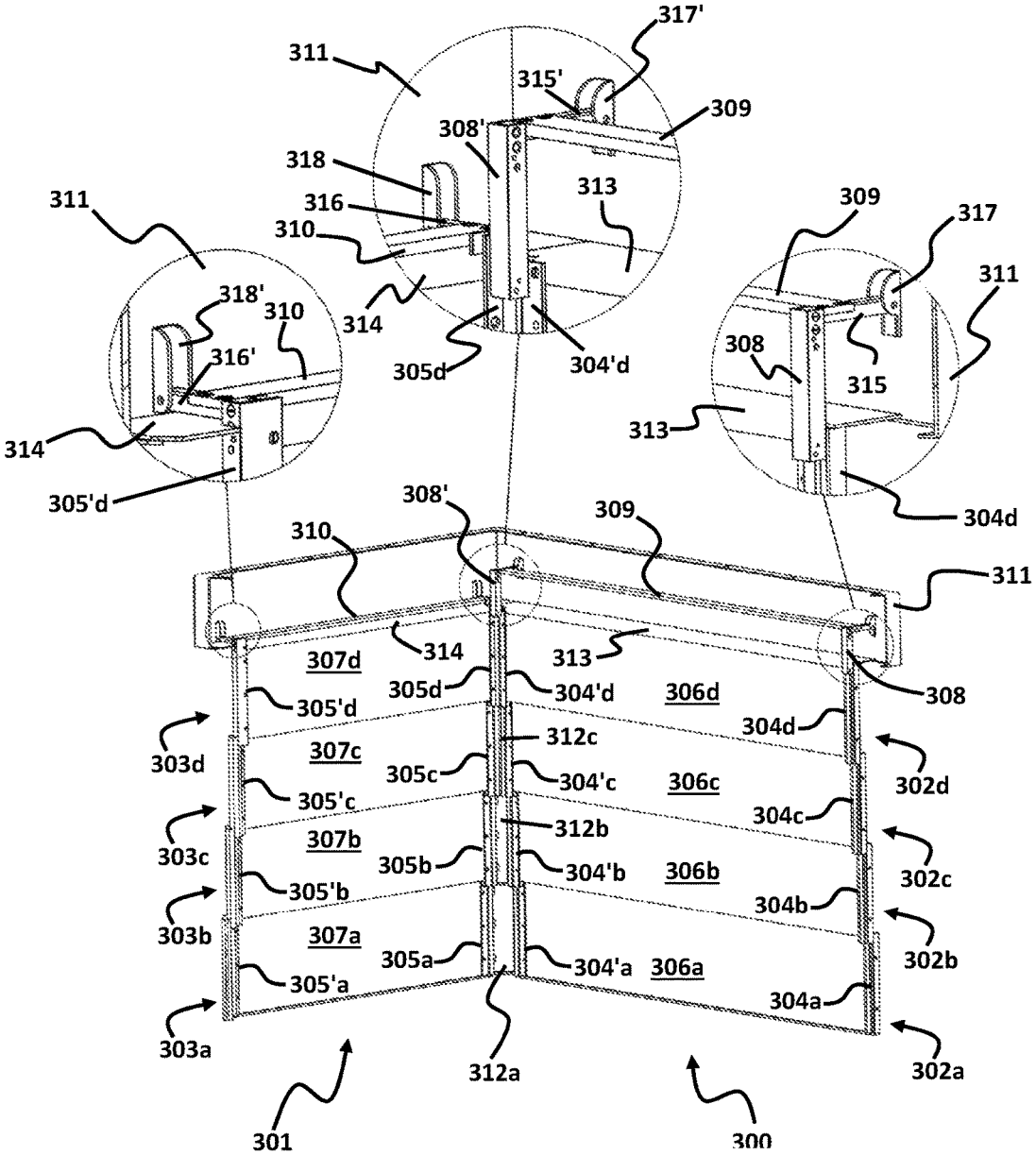
FIG. 3B illustrates an orthogonal view of a vertically slidable kitchen hood assembly, showing a rear wall assembly, a side wall assembly and a partial view of a top support structure, in accordance with at least one implementation of the present disclosure.
Figure 3C:
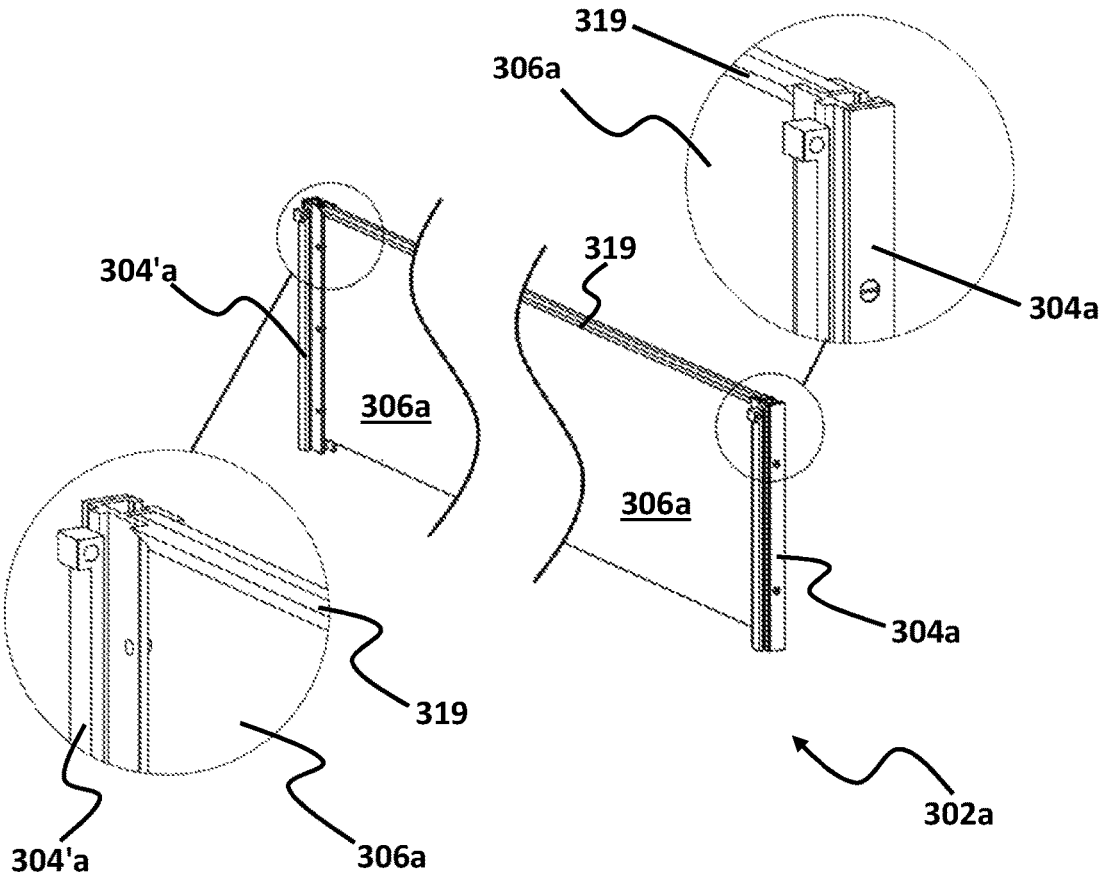
FIG. 3C illustrates one implementation of an example sub-panel assembly, according to one or more aspects of the present disclosure.

Referring to FIGS. 3A and 3C, in an aspect, a wall assembly 300 may include a number of sub-panel assemblies, for example four sub-panel assemblies 302*a*, 302*b*, 302*c*, and 302*d*. Each sub-panel assembly (such as sub-panel 302*a*), may include a panel 306*a* and two sliding track guides 304*a* and 304'*a* mountable on transverse sides of the panel.

The sub-panel assemblies 302*a*-302*d* may be slidably coupled by the sliding track guide 304*a*-304*d* on one side and the sliding track guide 304'*a*-304'*d* on the other side in order to form the vertically slidable wall assembly 300. The sub-panel assemblies 302*a*-302*d* may be interconnected offset from one another so as to be movable into overlapping positions. The vertically slidable wall assembly 300 may be slidably adjustable in a vertical direction between a fully retracted position and a fully extended position. The sub-panel assemblies 302*a*-302*d* can be movable upwardly into overlapping positions to retract the wall assembly 300 into the fully retracted position and be movable downwardly to extend the wall assembly 300 into the fully extended position.

In an example implementation, each panel 306*a*, 306*b*, 306*c*, or 306*d*, may be a planar elongated rectangular panel and can, for example be made of suitable transparent, translucent, semi-opaque or opaque glass, reinforced glass, polymers, or other like materials which are capable of tolerating high temperatures. Material selection may be carried out according to standards IEC-60335-1 (All types of household and similar electrical appliances—Safety) and IEC-60335-2-31 (Electrical range hood).

Figure 3D:
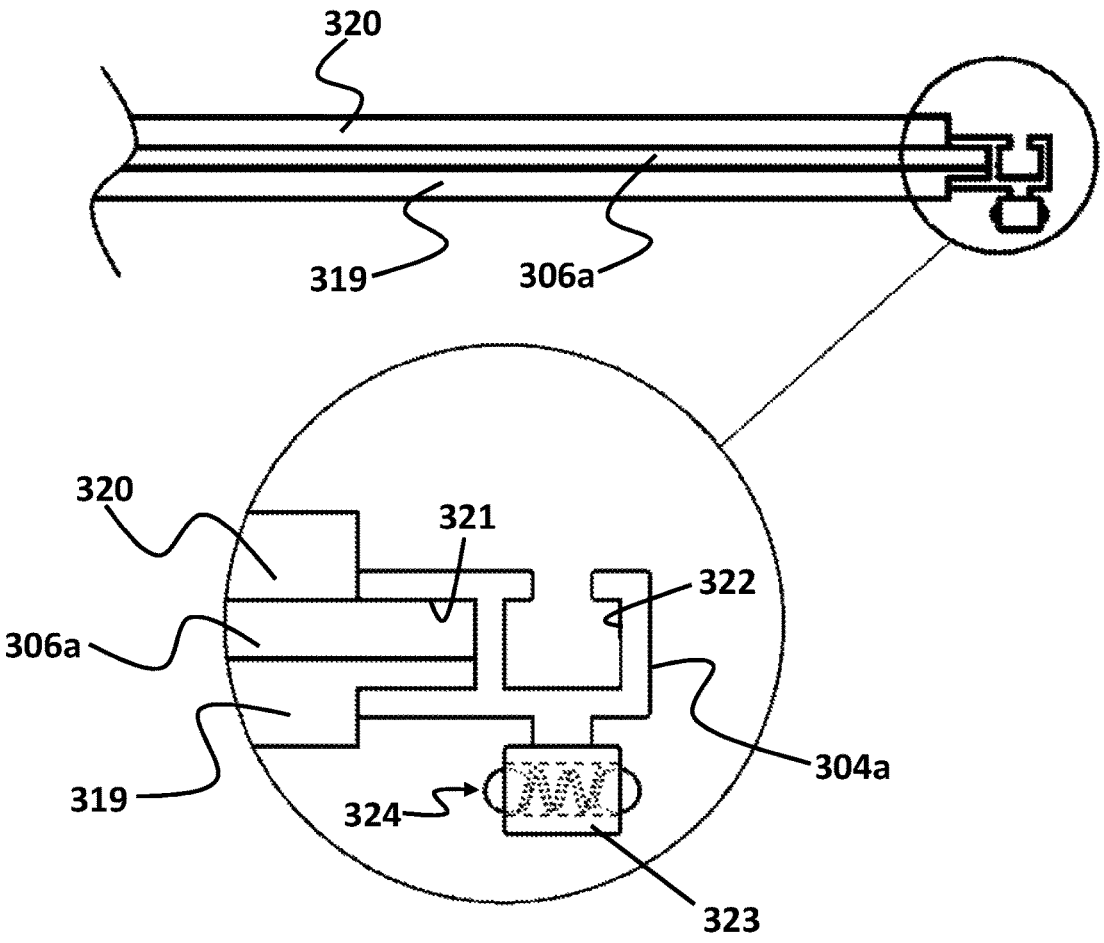
FIG. 3D illustrates a top view of the example sub-panel assembly of FIG. 3C.
Figure 3E:
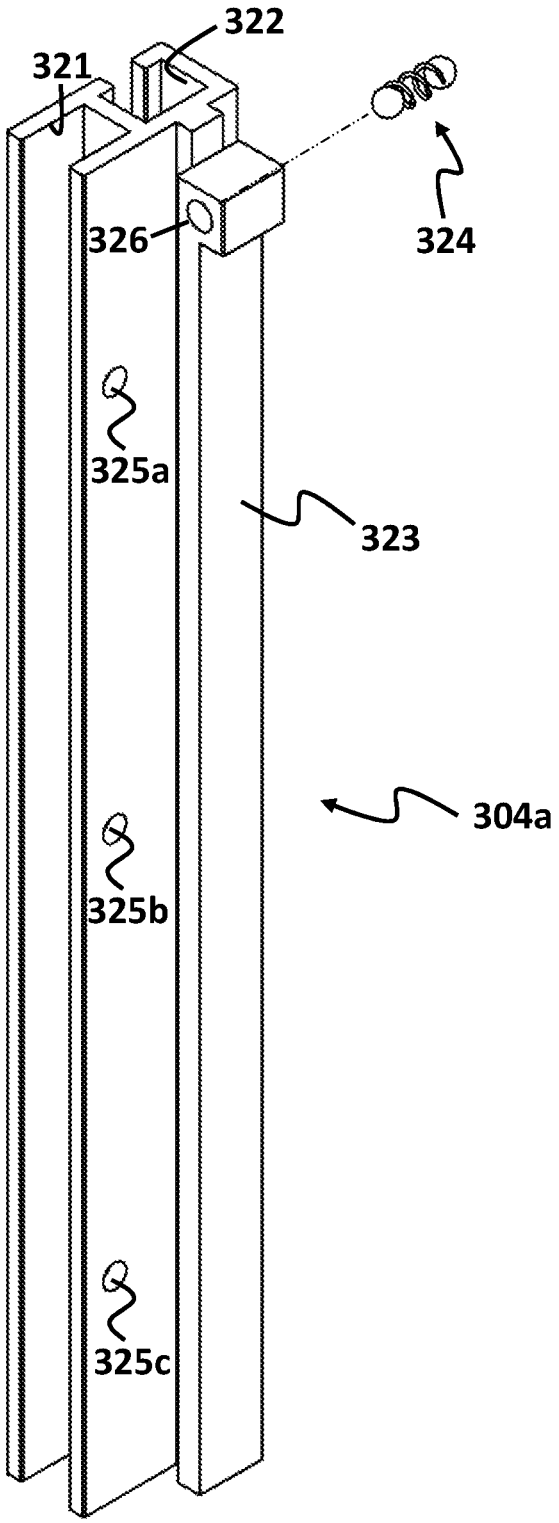
FIG. 3E illustrates a perspective view of an example sliding track mechanism, according to one or more aspects of the present disclosure.
Figure 3F:
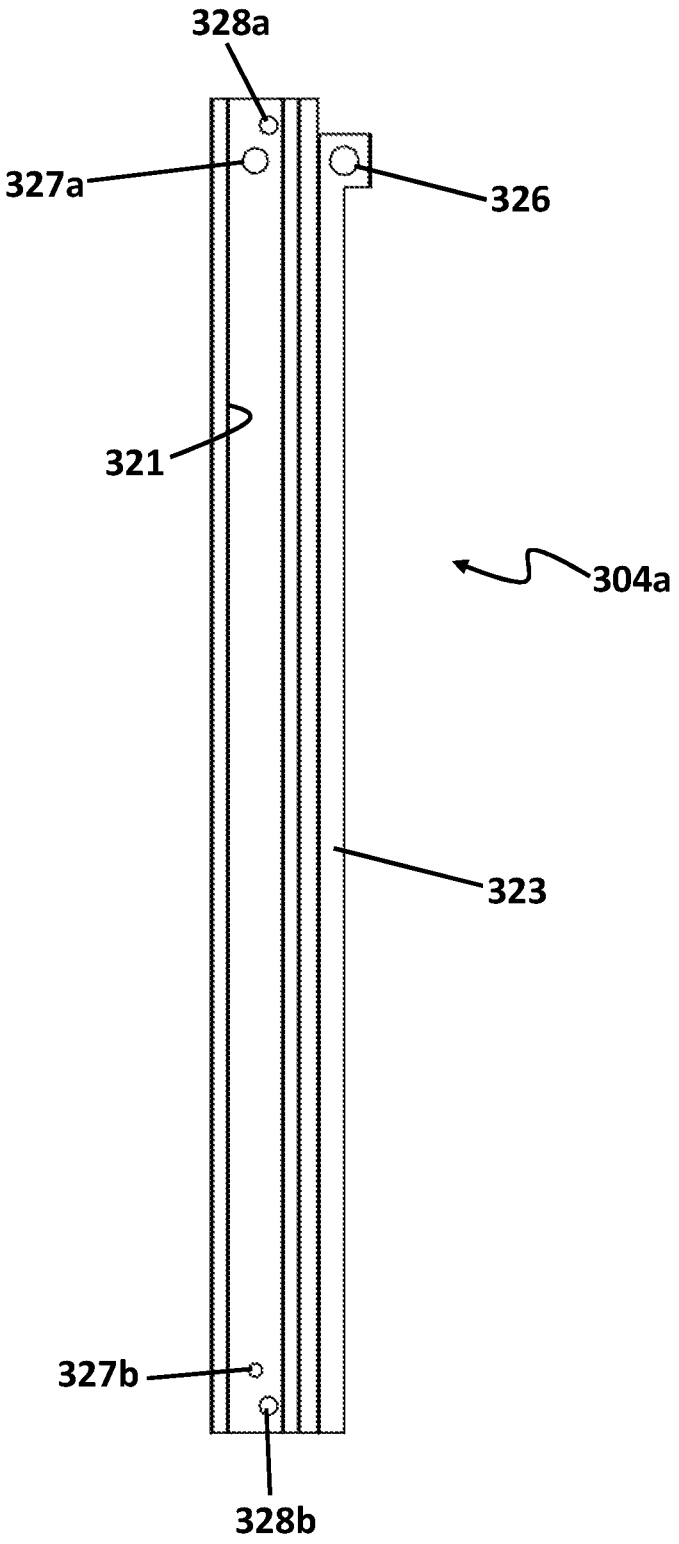
FIG. 3F is a left view of the example sliding track of FIG. 3E.

In one illustrative example, an interchangeable sub panel may be connected using a slider mechanism. Referring to FIGS. 3D-3F, each sliding track mechanism, for example the sliding track mechanism 304*a* can include a C-shaped longitudinally extending channel 322; a U-shaped longitudinally extending channel 321; and a sliding rail 323 that can include a ball plunger device 324. The ball plunger device 324 may be placed, for example in a through hole 326 in the sliding rail 323 of the sliding track guide 304*a*. Each sliding track mechanism, for example the sliding track mechanism 304*a* can include two ball detents 327*a* and 327*b*, namely the top ball detent 327*a* and the bottom ball detent 327*b*. Each sliding track mechanism, for example the sliding track mechanism 304*a* can include two pin holes 328*a* and 328*b*, namely the top pin hole 328*a* and the bottom pin hole 328*b*. The pin holes 328*a* and 328*b* may function to receive two pins that define the top and bottom limits of the sliding movements inside the C-shaped channel 322 of each track mechanism, for example track mechanism 304*a*.

The panel 306*a* may be configured to be received inside the U-shaped longitudinally extending channel 321 of the sliding track mechanism 304*a*. The panel 306*a* may be configured to be attached to the sliding track mechanism 304*a* by a number of fastening mechanism. For example, the panel 306*a* can be screwed to the U-shaped channel 321 of the sliding track mechanism 304*a* through a number of holes 325*a*-325*c* provided on the side of the U-shaped channel 321. Alternatively, the panel 306*a* can be snugly fitted inside the U-shaped channel 321. The top horizontally extending edge portion of each panel, for example panel 306*a* can be snugly receivable within a top sealing strip 319, either sides of the top sealing strip can be attached to the U-shaped channel 321 as shown in FIGS. 3C and 3D. The bottom horizontally extending edge portion of each panel, for example panel 306*a* can be snugly receivable within a bottom sealing strip 320. The top sealing strip 319 and the bottom sealing strip 320 function to provide an air-tight seal between two adjacent panels.

Figure 4A:
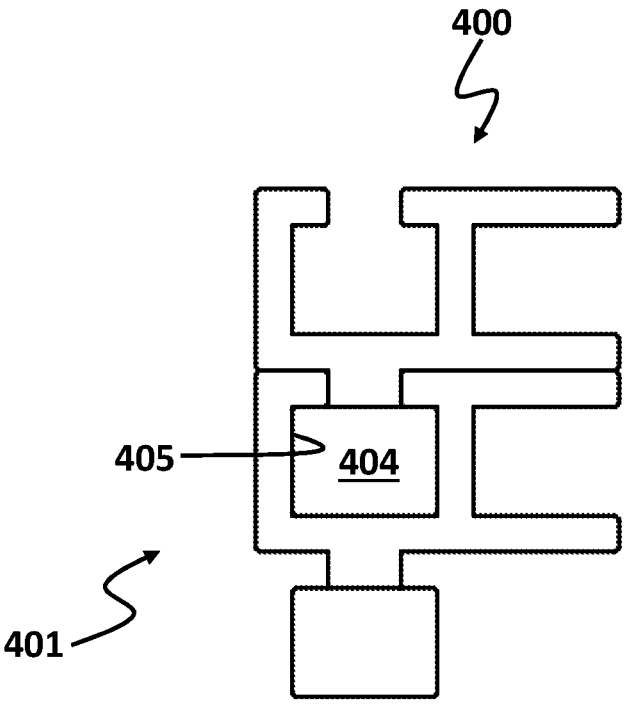
FIG. 4A illustrates a top view of an interconnected sliding mechanism, according to one or more aspects of the present disclosure.
Figure 4B:
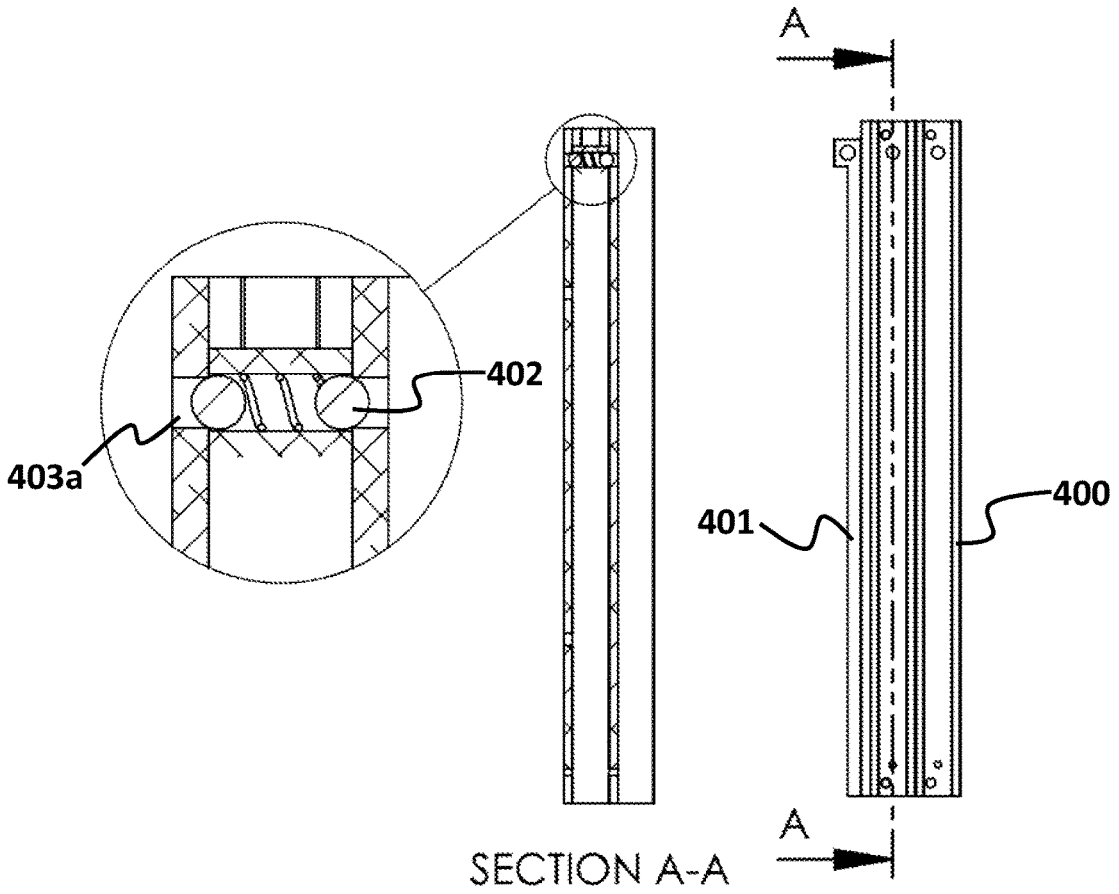
FIG. 4B illustrates a left view and a sectional view of two adjacent example sliding track mechanism in a fully retracted position, according to one or more aspects of the present disclosure.
Figure 4C:
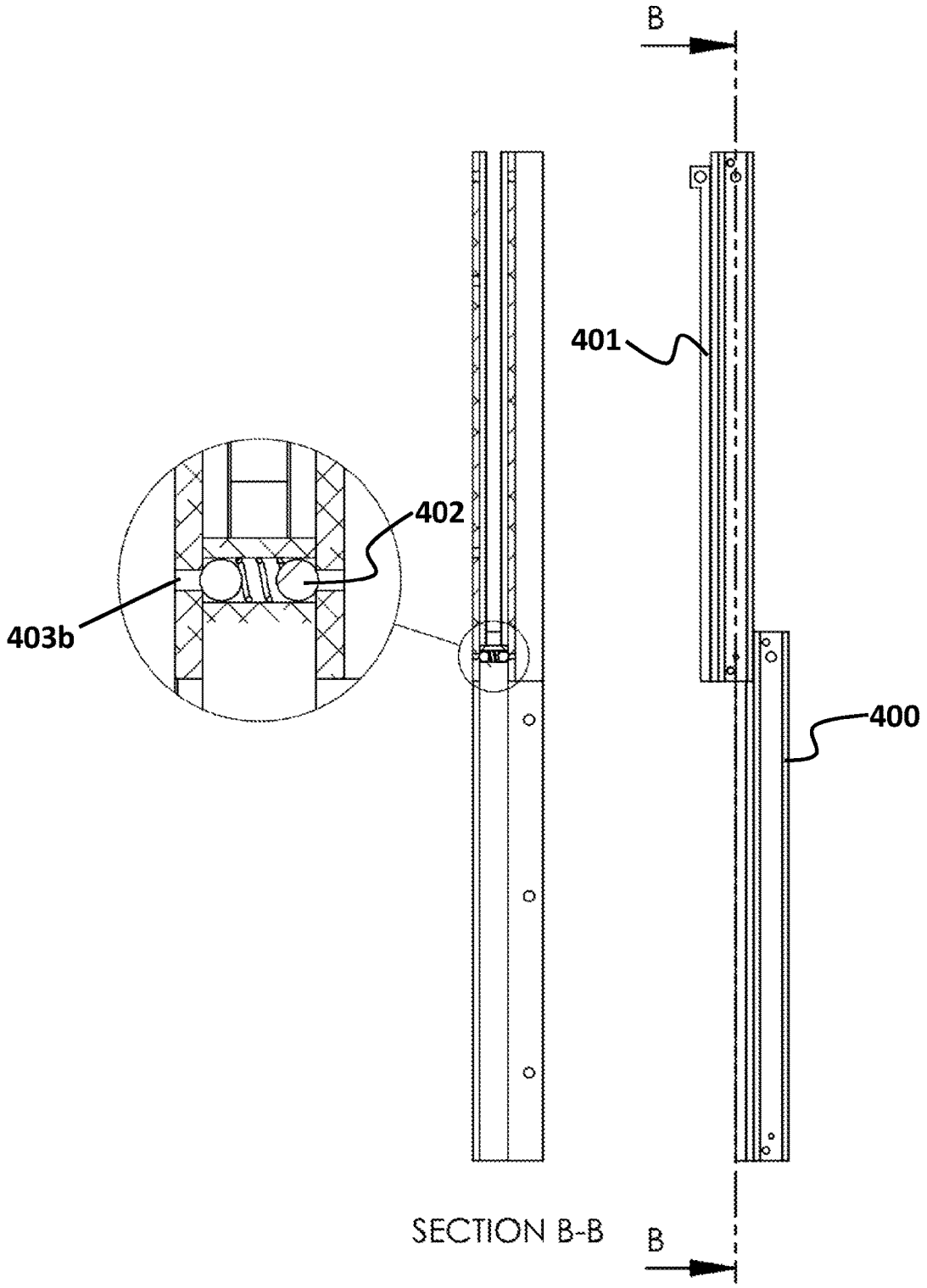
FIG. 4C illustrates a left view and a sectional view of two adjacent example sliding track mechanism in a fully extended position, according to one or more aspects of the present disclosure.

FIG. 4A shows a top view of the two adjacent track mechanism 400 and 401. As can be seen in this figure, the sliding rail 404 of the first track mechanism 400 is slidably movable within the C-shaped channel 405 of the second track mechanism 401. This allows the first track mechanism 400 to be vertically slidably movable within the C-shaped channel 405 of the second track mechanism 401. FIGS. 4B and 4C illustrate left and sectional views of the two track mechanisms 400 and 401 in a fully retracted position in FIG. 4B and in a fully extended position in FIG. 4C.

Referring to FIG. 4B, the second track mechanism 401 can include a top ball detent 403*a*, which is configured to receive a ball plunger device 402 of the first track mechanism 400, once the two track mechanisms 400 and 401 are in the fully retracted position. Referring to FIG. 4C, the second track mechanism 401 can include a bottom ball detent 403*b*, which is configured to receive the ball plunger device 402 of the first track mechanism 400, once the two track mechanisms 400 and 401 are in the fully extended position. The ball plunger device 402 and the two ball detents 403*a* and 403*b* function to lock the two adjacent track mechanisms 400 and 401 in fully retracted (FIG. 4B) and fully extended (FIG. 4C) positions.

FIG. 3B illustrates the top support structure 311, the rear wall assembly 300, and the side wall assembly 301. The rear wall assembly 300 can include four sub-panel assemblies 302*a*-302*d* and the side wall assembly 301 can include four sub-panel assemblies 303*a*-303*d*. The sub-panel assemblies 302*a*-302*d* are interconnected by sliding track mechanism 304*a*-304*d* on one side and track mechanism 304'*a*-304'*d* on the other side to form the vertically slidable wall assembly 300. The sub-panel assemblies 303*a*-303*d* are interconnected by sliding track mechanism 305*a*-305*d* on one side and track mechanism 305'*a*-305'*d* on the other side to form the vertically slidable wall assembly 301. The sub-panel assemblies 302*a*-302*d* include panels 306*a*-306*d* and the sub-panel assemblies 303*a*-303*d* include panels 307*a*-307*d*.

Referring to FIG. 3B, the rear upper sub-panel assembly 302*d* is configured to be coupled with the top support structure 311. According to one implementation, the rear upper sub-panel assembly 302*d* can be pivotally coupled with the top support structure 311. The track mechanism 304*d* and 304'*d* of the rear upper sub-panel assembly 302*d* can be attached to two rear extension tracks 308 and 308'. The two rear extension tracks 308 and 308' can be attached to two rear hinge arms 315 and 315', respectively. The two rear hinge arms 315 and 315' can be pivotally coupled with two rear hinges 317 and 317', respectively. The two rear hinges 317 and 317' can be attached on the top support structure 311. The rear hinges 317 and 317' function to allow folding the rear wall assembly 300 once in its fully retracted position under the top support structure 311. A rear top bar 309 can be utilized to attach the two rear hinge arms 315 and 315'. The rear top bar 309 functions to coordinate the folding movements of the two rear hinge arms 315 and 315' about pivot points of the two rear hinges 317 and 317'. In order to seal the area between the rear upper sub-panel assembly 302*d* and the top support structure 311 a rear top sealing part 313 can be attached to the rear upper sub-panel assembly 302*d*. The front wall assembly not shown in FIG. 3B and the rear wall assembly 300 can be of similar construction and configuration, therefore, only the rear wall assembly 300 is described in detail in this disclosure for sake of brevity of the description.

Referring again to FIG. 3B, the side upper sub-panel assembly 303*d* is configured to be coupled with the top support structure 311. According to one implementation, the side upper sub-panel assembly 303*d* can be pivotally coupled with the top support structure 311. The track mechanism 305*d* and 305'*d* of the side upper sub-panel assembly 303*d* can be attached to two side hinge arms 316 and 316'. The two side hinge arms 316 and 316' can be pivotally coupled with two side hinges 318 and 318', respectively. The two side hinges 318 and 318' can be attached on the top support structure 311. The side hinges 318 and 318' function to allow folding the side wall assembly 301 once in its fully retracted position under the top support structure 311. A side top bar 310 can be utilized to attach the two side hinge arms 316 and 316'. The side top bar 310 functions to coordinate the folding movements of the two side hinge arms 316 and 316' about pivot points of the two side hinges 318 and 318'. In order to seal the area between the side upper sub-panel assembly 303*d* and the top support structure 311 a side top sealing part 314 can be attached to the side upper sub-panel assembly 303*d*. The side wall assemblies can be of similar construction and configuration, therefore, only one side wall assembly 301 is described in detail in this disclosure.

Since the rear hinges 317 and 317' are mounted higher than the side hinges 318 and 318' (in order to allow folding of the rear wall assembly 300 on top of the side wall assembly 301) the rear extension tracks 308 and 308' can be used to compensate for this difference in elevation between the rear wall assembly 300 and the side wall assembly 301.

Referring also to FIG. 3D, in order to seal the area between the rear sub panel assemblies 302*a*-302*d* and the side sub-panel assemblies 303*a*-303*d*, a corner sealing part 312*a* can be attached from one side to the track mechanism 304'*a* and from the other side to the track mechanism 305*a*; a corner sealing part 312*b* can be attached from one side to the track mechanism 304'*b* and from the other side to the track mechanism 305*b*; and a corner sealing part 312*c* can be attached from one side to the track mechanism 304'*c* and from the other side to the track mechanism 305*c*.

Figure 8A:
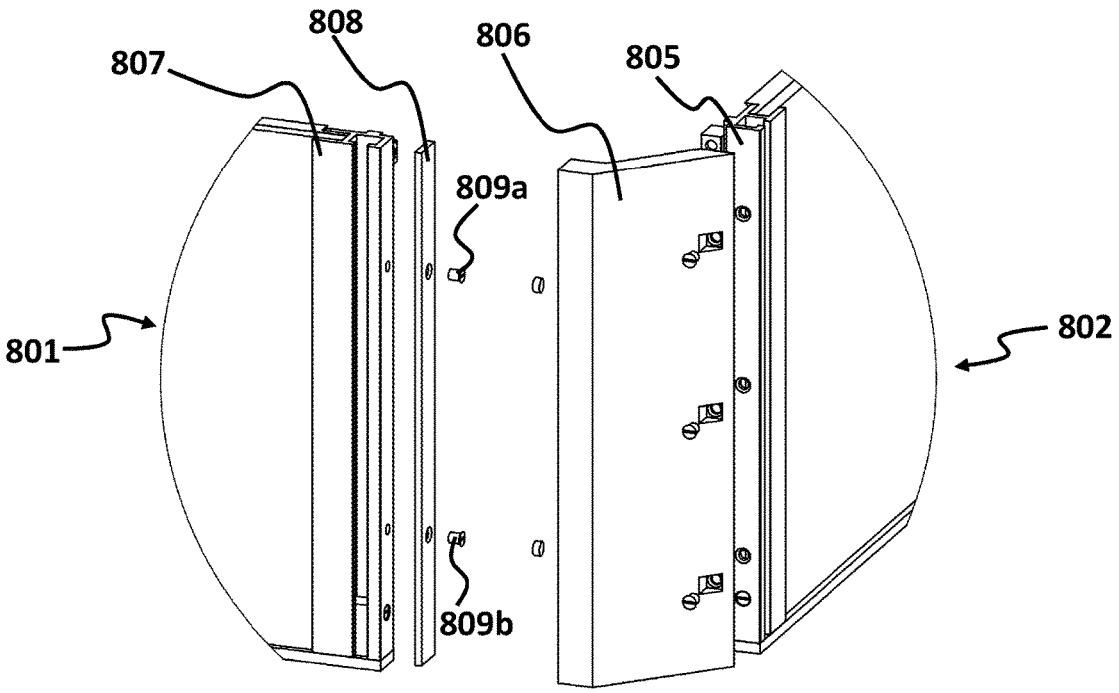
FIG. 8A illustrates an exploded view of an example corner sealing member.
Figure 8B:
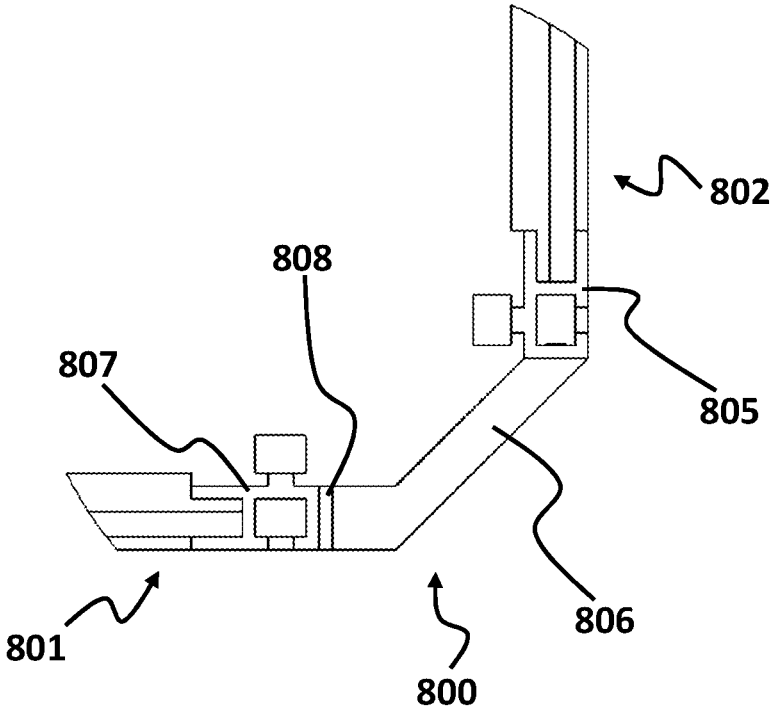
FIG. 8B illustrates a top view of the example corner sealing member of FIG. 8A.

FIGS. 8A and 8B show an example configuration of a corner sealing part 800. The corner sealing part 800 can include a large sealing member 806 and a small sealing member 808. The large sealing member 806 can be attached to a track mechanism 805 from one side and it can be placed tightly adjacent to the small sealing member 808. The small sealing member 808 can be attached to a track mechanism 807 from the other side. The large sealing member 806 can include a plurality of magnets that once next to the screws 809*a* and 809*b* on the small sealing member 808 can function to press the small 808 and large 806 sealing parts tightly together and provide an air-tight seal between two adjacent sub-panel assemblies 801 and 802.

Figure 5:
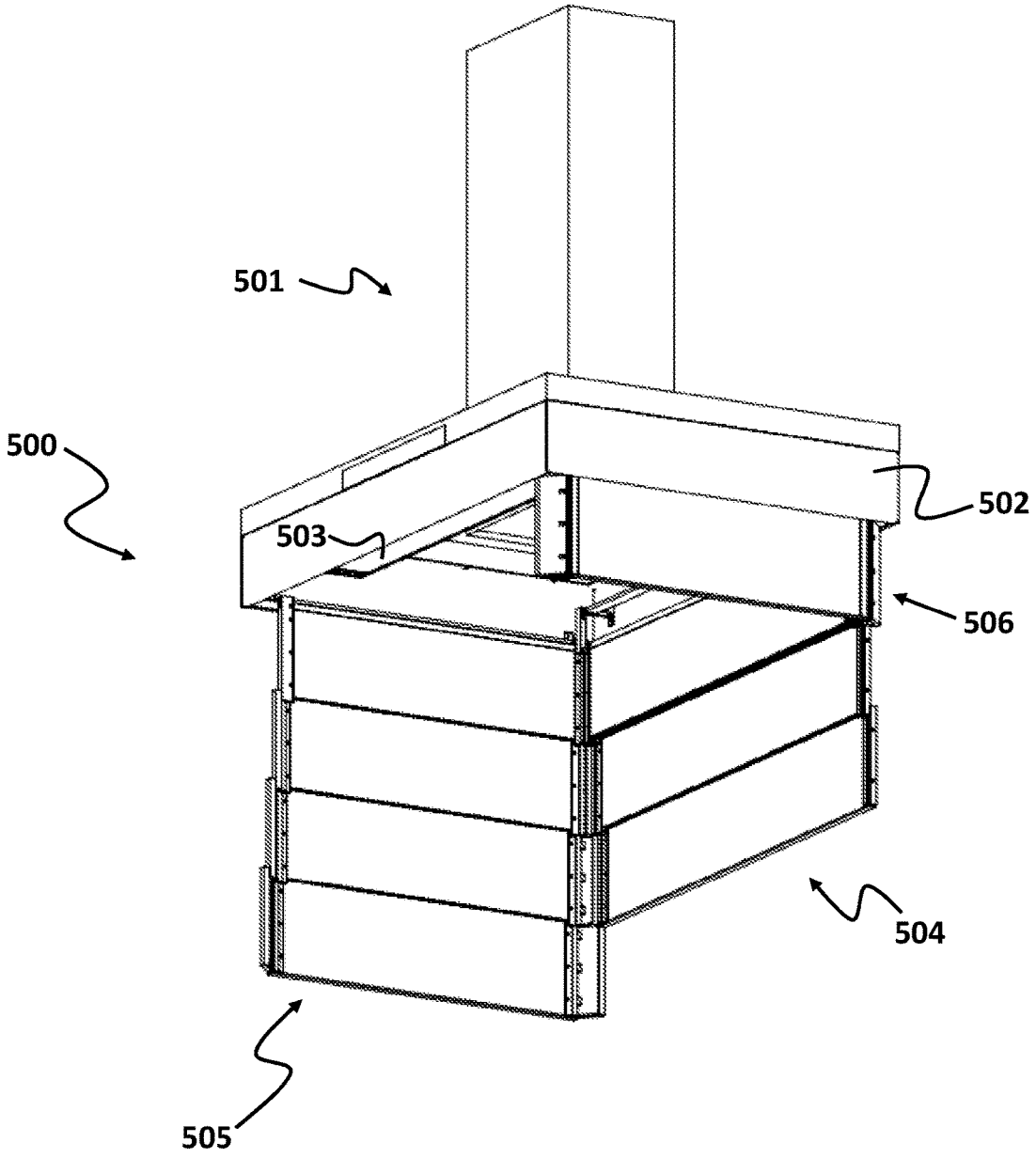
FIG. 5 illustrates an example vertically slidable kitchen hood assembly with its wall assemblies at different positions between fully retracted and folded position to a fully extended position.

Referring to FIG. 5 the wall assemblies 503, 504, 505, and 506 of the kitchen hood assembly 500 can be vertically adjustable between a retracted position under the hood 501 and an extended position over the surface of the fume-producing kitchen device. In one implementation, the wall assemblies 503, 504, 505, and 506 can be pivotally coupled with the top support structure 502, which can allow folding each wall assembly 503, 504, 505, or 506 under the hood assembly 501, while the wall assembly 503, 504, 505, or 506 is in its retracted position. As shown in FIG. 5, each wall assembly 503, 504, 505, or 506 can be configured to be vertically adjustable independent from other wall assemblies. In this figure, the front wall assembly 503 is in a fully retracted and folded position under the hood assembly 501, the right wall assembly 506 is in a partially extended/retracted position, the rear wall assembly 504 is in a partially extended/retracted position, and the left wall assembly 505 is in a fully vertically extended position.

Figure 6:
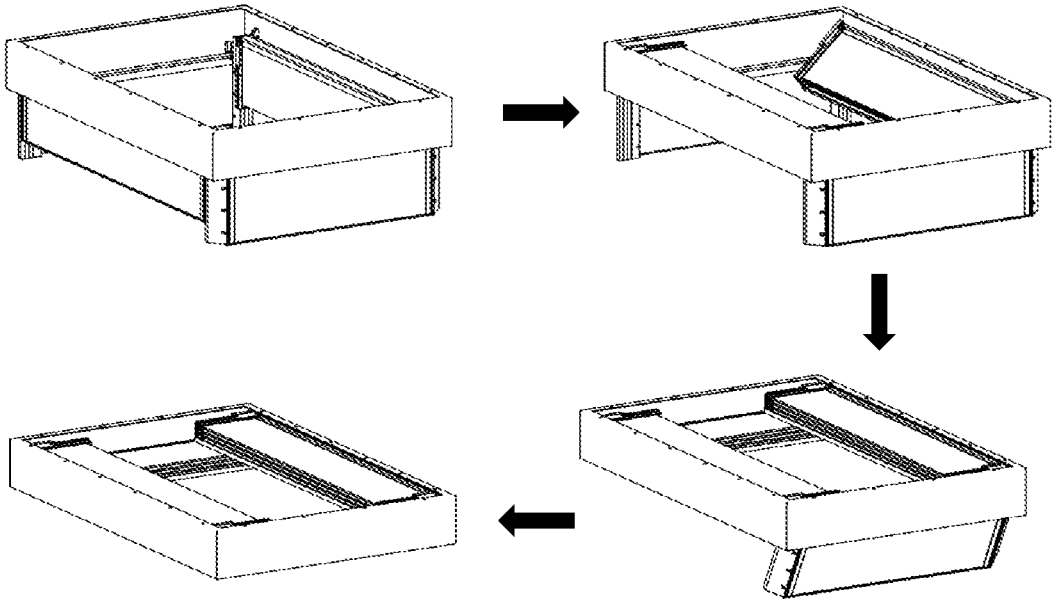
FIG. 6 illustrates an example folding panel for an example kitchen hood assembly.

FIG. 6 shows how the wall assemblies pivotally coupled with the top support structure can be folded under the top support structure. In this figure the example steps of folding are shown sequentially and black arrows are used to show the consecutive steps of the example folding process.

Figure 7:
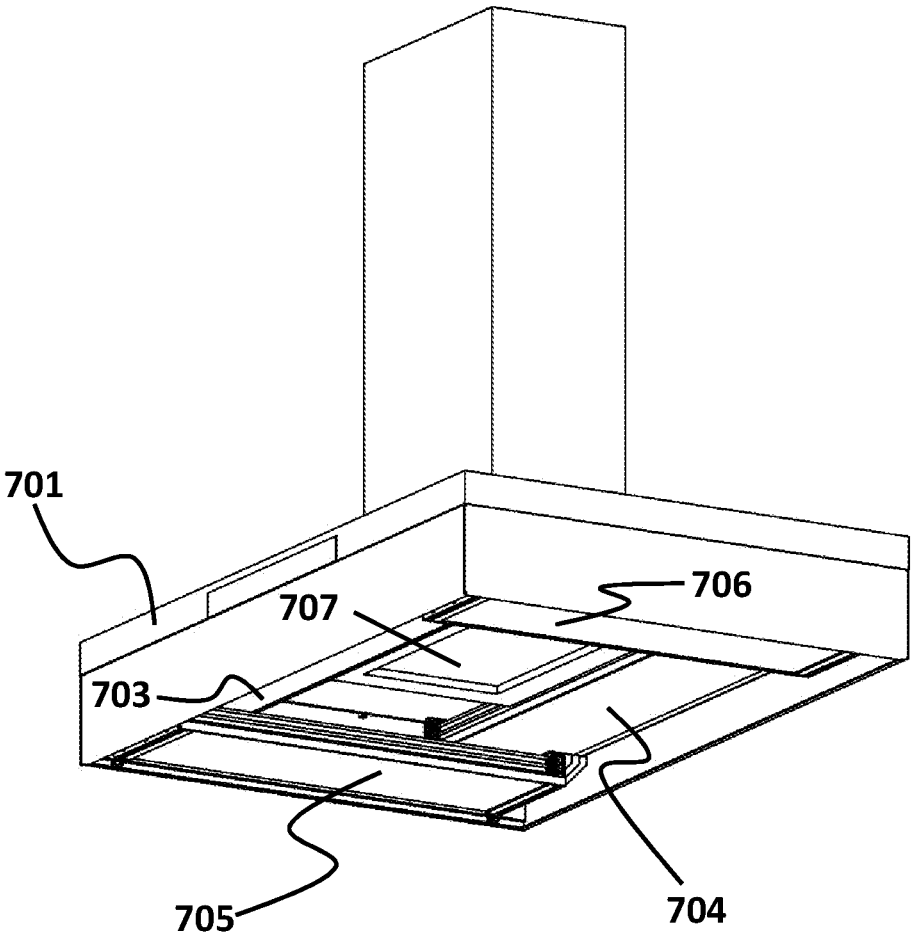
FIG. 7 illustrates one implementation of an example vertically slidable kitchen hood assembly with all its wall assemblies folded under the kitchen hood assembly.

As shown in FIG. 7 the wall assemblies and their sub-panel assemblies are sized, such that, once all the wall assemblies 703, 704, 705, and 706 are folded under the hood assembly 701, the exhaustion opening 707 of the hood 701 is fully open and it can function normally as a normal hood without an enclosure assembly.

According to other implementations, each wall assembly can include sub-panel assemblies hinged together instead of being slidably interconnected. In this implementation, the sub-panel assemblies that are pivotally interconnected are capable of being folded and expanded under the hood assembly.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 105 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. An enclosure configured to be mounted to a kitchen hood exterior, the enclosure comprising:

four vertically extendable wall assemblies forming four sides of the enclosure, each of the wall assemblies comprise:

a plurality of sub-panel assemblies slidably interconnected with each other, each of the sub-panel assemblies comprise:

a panel; and two sliding track mechanisms mounted on either transverse side of the panel, wherein, each of the wall assemblies is vertically adjustable between a fully retracted position and a fully vertically extended position independent from the other wall assemblies.

2. The enclosure according to claim 1, wherein each of the four vertically extendable wall assemblies is foldable under the hood assembly in their fully retracted position.

3. The enclosure according to claim 1, wherein the panel is made of a material selected from the group consisting of transparent glass, translucent glass, semi-opaque glass, opaque glass, reinforced glass, or polymers.

4. The enclosure according to claim 1, further comprising:

a top support assembly configured to be attached under the hood assembly, wherein, each of the four vertically extendable wall assemblies is pivotally attached to the top support assembly.

5. The enclosure according to claim 4, wherein the four vertically extendable wall assemblies further comprise of one or more pivotal connectors such that the wall assemblies are pivotally coupled with the top support assembly.

6. The enclosure according to claim 1, wherein each of the sliding track mechanisms comprises:

a two-channel slide track including a vertically extended C-shaped channel and a vertically extended U-shaped channel, wherein the vertically extended U-shaped channel is configured to snugly receive the panel; and a protruding sliding rail attached to the two-channel slide track.

7. The enclosure according to claim 6, wherein the sub-panel assemblies are slidably interconnected offset from each other by slidably coupling protruding sliding rails of the two sliding track mechanisms of each sub-panel assembly within C-shaped channels of two corresponding sliding track mechanisms of a vertically adjacent sub-panel assembly.

8. A method for improving fume capture efficiency of a hood assembly, wherein the hood assembly is placed above a fume-producing device, the method comprising:

providing four wall assemblies forming four sides of an enclosure, each of the wall assemblies is vertically extendable independent from the other wall assemblies; and mounting the enclosure under the hood assembly, wherein, the enclosure encloses an area under the hood assembly over the fume-producing device.

9. The method according to claim 8, wherein each of the wall assemblies is vertically extendable from a fully retracted position under the hood assembly to a fully vertically extended position above the fume producing device.

10. The method according to claim 8, wherein mounting the enclosure under the hood assembly includes mounting the enclosure on a surface near the hood assembly.

* * * * *